US008316894B2

(12) United States Patent
Schaub

(10) Patent No.: US 8,316,894 B2
(45) Date of Patent: Nov. 27, 2012

(54) MODULAR ADJUSTABLE FRAME HAND LOOM

(76) Inventor: Rene Schaub, Elk Grove, CA (US)

( * ) Notice: Subject to any disclaimer, the term of this patent is extended or adjusted under 35 U.S.C. 154(b) by 107 days.

(21) Appl. No.: 13/086,051

(22) Filed: Apr. 13, 2011

(65) Prior Publication Data

US 2011/0259465 A1 Oct. 27, 2011

Related U.S. Application Data

(60) Provisional application No. 61/327,353, filed on Apr. 23, 2010.

(51) Int. Cl.
*D03D 29/00* (2006.01)
*D03D 41/00* (2006.01)

(52) U.S. Cl. ..... 139/29; 139/1 R; 139/11; 139/34

(58) Field of Classification Search ..... 139/1 R, 139/11, 29–34
See application file for complete search history.

(56) References Cited

U.S. PATENT DOCUMENTS

| | | | | | |
|---|---|---|---|---|---|
| 244,452 | A | * | 7/1881 | Halstenbach | 223/48 |
| 1,160,132 | A | * | 11/1915 | Bliss | 139/33 |
| 1,506,010 | A | * | 8/1924 | Lapin | 206/495 |
| 2,043,082 | A | * | 6/1936 | Wallach | 28/151 |
| 2,072,668 | A | | 7/1936 | Eltgroth | |
| 2,094,505 | A | * | 9/1937 | Thackeray | 139/33 |
| 2,237,733 | A | | 3/1939 | Grimm et al. | |
| 2,433,307 | A | | 9/1945 | Thomas | |
| 2,481,955 | A | * | 9/1949 | Simons | 139/33 |
| 2,563,510 | A | * | 8/1951 | Bellin | 139/1 R |
| 2,582,008 | A | * | 1/1952 | Clack | 139/33 |
| 2,797,710 | A | * | 7/1957 | Bintz et al. | 139/33 |
| 3,332,448 | A | * | 7/1967 | Simons | 139/29 |
| 3,665,971 | A | * | 5/1972 | Ileks | 139/33 |
| 3,738,395 | A | * | 6/1973 | Stars | 139/29 |
| 3,800,372 | A | | 4/1974 | Daoust | |
| 3,812,887 | A | * | 5/1974 | Stars | 139/29 |
| 3,870,087 | A | * | 3/1975 | Henwood | 139/33 |
| 3,967,467 | A | | 7/1976 | Leach | |
| 3,971,417 | A | * | 7/1976 | Gentil | 139/34 |
| 4,023,245 | A | | 5/1977 | Zaltzman | |
| 4,046,171 | A | * | 9/1977 | Wilson | 139/29 |
| 4,074,726 | A | * | 2/1978 | Harris | 139/29 |
| 4,103,715 | A | * | 8/1978 | Harris | 139/33 |
| 4,109,685 | A | * | 8/1978 | Westin | 139/33 |
| 4,131,138 | A | * | 12/1978 | Boisvert | 139/29 |
| 4,160,467 | A | * | 7/1979 | Woodruff | 139/33 |
| 4,178,970 | A | * | 12/1979 | Mueller | 139/30 |
| 4,244,400 | A | * | 1/1981 | Edwards | 139/33 |
| 4,248,063 | A | | 2/1981 | Wang | |
| 4,301,839 | A | * | 11/1981 | Yamaguchi et al. | 139/29 |

(Continued)

*Primary Examiner* — Bobby Muromoto, Jr.
(74) *Attorney, Agent, or Firm* — Lackenbach Siegel, LLP; Myron Greenspan

(57) ABSTRACT

An adjustable knitting and weaving hand loom includes differently shaped elongate sections. Tabs and channels connect the sections to form a closed frame by connecting adjoining sections in end-to-end abutment. The tabs and mating channels form sliding joints between adjoining sections. Each of the sections is provided with a series of substantially uniformly spaced holes or bores. End-most holes through the tabs and the channels are aligned when the axial tabs are fully slidably mated within associated axial channels. Pegs are dimensioned to be received both within aligned end-most holes at each slip joint and intermediate holes. The pegs are inserted into aligned end-most bores or holes function both to secure yarn during knitting and to lock the axial tabs from inadvertently separating from mating axial channels by movements along the direction of insertion.

20 Claims, 12 Drawing Sheets

U.S. PATENT DOCUMENTS

| | | | | | |
|---|---|---|---|---|---|
| 4,305,431 | A | * | 12/1981 | Ivarsson | 139/29 |
| 4,310,030 | A | * | 1/1982 | Yarlovsky | 139/29 |
| 4,416,040 | A | | 11/1983 | Towsley | |
| 4,462,432 | A | * | 7/1984 | Sajo et al. | 139/33 |
| 4,489,761 | A | * | 12/1984 | van Gulik | 139/29 |
| 4,729,229 | A | | 3/1988 | Whicker | |
| 4,741,366 | A | * | 5/1988 | Yamotogi | 139/34 |
| 4,825,910 | A | * | 5/1989 | Jonsson | 139/29 |
| 4,832,085 | A | * | 5/1989 | Northrup | 139/34 |
| 7,147,009 | B1 | * | 12/2006 | Murcar | 139/33 |
| D563,977 | S | | 3/2008 | Carl et al. | |
| 7,424,898 | B2 | * | 9/2008 | Holly | 139/29 |
| 7,506,524 | B2 | | 3/2009 | Gustin | |
| 7,677,273 | B2 | * | 3/2010 | Skaflestad | 139/29 |
| 7,748,413 | B2 | * | 7/2010 | Kojima | 139/21 |
| 8,132,596 | B2 | * | 3/2012 | Weidler et al. | 139/29 |
| 2002/0153050 | A1 | * | 10/2002 | Jenner et al. | 139/29 |
| 2005/0205150 | A1 | * | 9/2005 | Jenner et al. | 139/11 |
| 2005/0247745 | A1 | * | 11/2005 | Spor et al. | 223/48 |
| 2009/0126822 | A1 | * | 5/2009 | Kojima | 139/29 |
| 2010/0212770 | A1 | * | 8/2010 | Weidler et al. | 139/33 |
| 2010/0218840 | A1 | * | 9/2010 | Crorey | 139/29 |

* cited by examiner

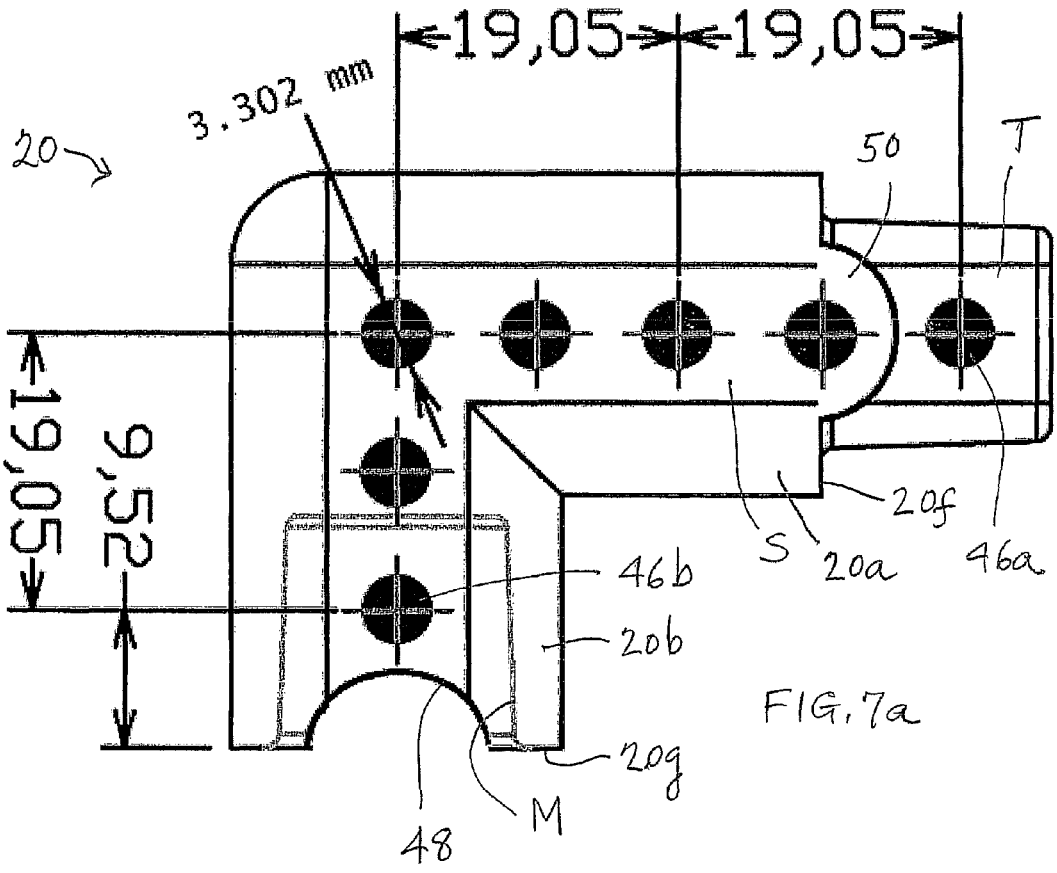
FIG. 7a
FIG. 7b
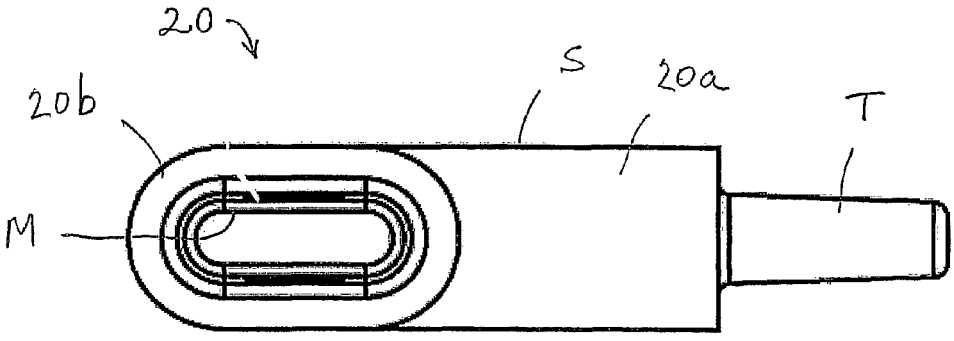

41,28
19,05
9,53
9,53 TYP
Ø4,76 TYP
22,23
63,5
12,7
10,92
22
22a
22b
22c
46
46a
46b
48
50
S
T
M
8e
8f 72,9
15,7
22,2
9,5
Ø4,8TYP
48
46
50
T
46a
18
9g 12,7

M
S
52

9,525TYP
Ø2,5TYP

46b 130,0
15,7
46a
S
48
46b
16
46
ø4,8TYP
9,525TYP
50
T
10f

M
10,9

85,7
9,5TYP
ø2,5TYP
52

48
11e
50
9,5
ø2,5TYP
11e
52

48
M
5
46
10,9
10,9
46a
T 12,7
T 48
46b
5
46
342,9
50
9,5TYP
46a
ø4,8TYP
T 23
46
46a
48
50
52
56
T
M
S
9,8TYP
9,847
R95,3
R73,0
ø2,5TYP
9,8TYP
12,7
10,9
B-B

MODULAR ADJUSTABLE FRAME HAND LOOM

CROSS REFERENCE TO RELATED APPLICATION

This application is related and claims priority of Provisional Patent Application Ser. No. 61/327,353 filed Apr. 23, 2010.

BACKGROUND OF THE INVENTION

1. Field of the Invention

The present invention generally relates to frame looms and, more specifically, to a kit for a modular adjustable frame hand loom suitable for knitting and weaving yarns.

2. Description of the Prior Art

Knitting and weaving have long been popular hobbies and a large variety of items can be made on a loom in the form of a frame generally having a shape corresponding to the article to be made. A typical loom includes pegs that project from the frame around which the yarn is looped in various ways, such as running back and forth between opposite sides of the frame. However, there are limitations associated with frame-knitting devices characterized by the prior art. Typically, loops of yarn are attached or looped about the pegs and, depending on the spacing between the pegs it may be difficult to manipulate the loops. Circular frames, for example, are normally used for knit tubular fabrics. However, in order to knit material of different sizes and shapes many frames of different sizes are required.

One example of a generally fixed frame loom is illustrated in U.S. Pat. No. D563,977 for a long knitting loom. A similar knitting loom is disclosed in U.S. Pat. No. 7,506,524. To overcome the deficiencies or disadvantages of a fixed frame loom, one or more cross-bridges are disclosed in the last-mentioned patent that are connected to the base structure and traverse two parallel spaced bars. By including such cross-bridges at selected locations the loom can provide additional pins between the parallel bars to effectively change the longitudinal length of the frame along its length direction. Such cross-bridges are intended to configure the loom to produce different working lengths and a circular knit having a diameter smaller than the effective length of the overall loom.

A fixed frame loom is also disclosed in U.S. Pat. No. 4,729,229 that provides rows of pins on opposite sides of a slot. The pins are integrally molded in a replaceable insert member that may be removed from the frame of the device and replaced by another insert member that has pins that are spaced differently, of different diameters, or perhaps different elastic characteristics. However, the general configuration and size of the frame remains fixed.

In order to overcome some of the disadvantages associated with fixed frame looms, various adjustable frame looms have been proposed. An early example of such an adjustable loom is disclosed in U.S. Pat. No. 2,072,668 in which a pair of bars is provided with traverse holes to receive threaded bolts. Each bolt is equipped with a wing nut, springs being disposed on the bolts between the bars to normally urge the bars apart to the extent permitted by the adjustable wing nuts. By using such a construction, there is a limited ability to separate the bars and increase the distance between the pins on which the yarn is looped around. A similar knitting device is disclosed in U.S. Pat. No. 2,237,733 in which spacing washers are disposed on the bolts between the bars for providing a predetermined distance or spacing of the slot for a desired width of the fabric to be knitted.

An early adjustable hand weaving frame loom is disclosed in U.S. Pat. No. 2,433,307. However, while this loom is constructed so that modular sections can be arranged end-to-end and formed into various polygonal shapes or sizes, the sections are held together by two spaced bores on one section and aligned pins on another mating section. However, there is no locking feature that maintains the connected sections connected to each other, and pulling one section of the frame relative to the other could separate the sections from each other.

An adjustable loom disclosed in U.S. Pat. No. 3,800,372 includes upper and lower rails with elongated slots and left and right hand rails with tongues at their ends that are adjustably receivable in elongated slots of the upper and lower rails. Each of the rails has a row of openings that are equally spaced from each other and headed pins are received in desired openings. The pins that are received in the intermediate rails are longer than those that are mounted on the other rails so that the tops of all the pins lie in the same plane. Separate corner posts must be used, however, to secure the rails together in their adjusted positions. The corner post may be used to adjust the trimmer in which the loom is adjusted for knitting articles of different sizes but cannot serve as pegs for looping yarn. The loom may also be disassembled for storage.

A manual knitting frame is disclosed in U.S. Pat. No. 3,967,467 that consists of two parallel bars held apart to create a relatively narrow slot between them. Each bar carries a row of spaced upright pins on which yarn may be looped during knitting. To vary and standardize the length of the stitches an adjustable member is provided for spacing the bars apart for any one of several fixed but selectable distances. A stitch selector is provided for this purpose that has a series of notches that can be engaged with a fixed detent.

Another knitting frame formed of two parallel bars that are adjustably spaced from each other is disclosed in U.S. Pat. No. 4,248,063. However, to adjust the spacing between the elongated members rods pass through the bars, some of which are threaded and carry rotating knobs used for adjustments. The frame is bulky and costly to produce and not intended to be assembled or disassembled by the user.

A handloom construction that utilizes separate pieces or modules is disclosed in U.S. Pat. No. 4,023,245. The construction contemplates the use of end-to-end frame modules. Connection of modules utilizes an additional pin that serves both as a pin unit spacing of both connected modules. However, in order to lock and retain the geometry of a selected or desired frame configuration special fasteners must be used at the ends of the modules. Failure to adequately tighten them may result in shifting of connected modules relative to one another and, therefore, modification of the desired frame geometry.

A weaving loom is disclosed in U.S. Pat. No. 4,416,040 that includes a plurality of interchangeable sections that together form a loom frame. The sections are separately connected together end-to-end. However, the loom employs a tab and slot construction at the butting ends that not only prevents them from being pulled apart axially but allows the sections to be disconnected when one section is twisted downwardly relative to the other section. Therefore, by placing undesired stresses on the loom or loom sections the sections may inadvertently separate. Additionally, because of the manner in which connected sections are disconnected from each other, requiring twisting of the elements relative to each other, this loom is less convenient and less easy to use since improper twisting may prevent quick or simple disassembly.

SUMMARY OF THE INVENTION

Accordingly, it is an object of the present invention to provide a modular adjustable frame hand loom that overcomes the disadvantages inherent in prior art hand looms.

It is another object of the invention to provide a modular adjustable frame hand loom that is simple in construction and economical to manufacture.

It is still another object of the invention to provide a hand loom that is modular and adjustable to selectively provide numerous loom configurations, including square, rectangular, oval and circular suitable for knitting or weaving.

It is yet another object of the invention to provide a hand loom having bars provided with indexed holes and correspondingly configured leg portions on pegs or pins so that the pegs or pins can only be inserted on the bars of the loom with an orientation to outwardly expose elongate axial recesses or guides for guiding needle ends along the external surfaces of the shanks of the pins or pegs.

It is a further object of the invention to provide a hand loom that includes different sized pegs that can be selectively inserted into the bars forming the loom for accommodation of different weight yarns.

It is still a further object of the invention to provide pegs or pins that are color coded to facilitate marking and looping of yarns to create desired patterns.

It is an additional object of the invention to provide a hand loom that is simple and quick to assemble into a desired shape or configuration and disassemble for storage.

It is still an additional object of the invention to provide a hand loom as in the previous object in which end pegs or pins on each linear bar of the loom can be inserted into lined holes on matting tenon and mortise—type elements to lock associated or connected loom linear members or bars to prevent a situation of a loom after it has been assembled.

It is yet an additional object of the invention to provide a hand loom of the type under discussion that allows for modification not only of the size of the selected loom but also the geometrical configuration thereof.

It is also another object of the invention to provide a kit that includes all component parts packaged together for retail sale to consumers in non-assembled form that allows the consumer to achieve the above mentioned objects.

It is also a further object of the invention to provide a method of assembling a modular adjustable frame hand loom of the type suggested in the above objects.

In order to achieve above objects, as well the others that will become here and after, a modular adjustable frame hand loom comprises a plurality of generally elongated sections each of which defines an upper surface and opposing first and second ends. Connecting means are provided for connecting said sections to form a closed frame by connecting a section with two other joining sections in end-to-end abutment by joining a first end of one section with the second end of another joining section. Such connecting means comprises a tenon type axial tab at each first end and a mortise type axial channel at each second end to provide a sliding joint between each two adjoining sections by inserting an axial tab of one section into an axial channel of the adjoining section to provide a stable joint that substantially prevents relative movements between two adjoining sections except along the direction of insertion of said axial tab into said axial channel. Each of said sections is provided with a top surface in said axial tab with a series of substantially uniformly spaced holes or bores, each having an axis substantially normal to said top surface. Holes or bores are arranged on the tabs and coextensive over the channels to align end-most holes or bores at said second ends with said holes or bores in said axial tabs, at said first ends, when said axial tabs are fully slidably inserted and mated with associated axial channels. A plurality of pegs or pins are provided and dimensioned to be securely received within a hole or bore of one of said sections. Said pegs or pins are dimensioned to be received within said aligned holes or bores at both said second ends and within said tabs at said first ends at each slip joint. In this manner, said pegs or pins inserted into said bores or holes at said second ends and into said holes or bores in said tabs at said first ends function as lock pegs to both secure yarn during knitting as well as to lock said axial tabs from separating from mating axial channels against movements along said direction of insertion. By providing a non-circular cross sectional shape to the legs of the pegs or pins into correspondingly shaped holes in said upper surface, the pins are indexed to always be oriented in a direction to outwardly expose vertical or longitudinal channels or grooves on the pegs to guide the tips or needles or hooks thereby facilitating the gripping of yarns during knitting or weaving. A modular adjustable frame hand loom kit is also disclosed that consists of an assembly of components packaged together for retail sales to consumers in a non-assembled form which comprises a plurality of differently configured and sized bars to allow a user to quickly and simply assemble differently shaped looms, including rectangular, square, oval and circular and also change sizes of some of these looms to accommodate the yarn being used and the nature of the product to be created. The kit also includes differently sized pegs or pins. The pegs or pins may be color coded to facilitate marking of yarns and facilitate the creation of intricate designs. All of the component parts of the kit are housed within an insert in the box that organizes the various component parts, including knitting needles and a weaving tool, so that a user has everything that is needed or required to create different crafted products and for storing parts after they have been disassembled for storage and future use.

A method of assembling of a modular adjustable frame hand loom in accordance with the invention involves connecting different loom bars or elements in end-to-end abutment by inserting the tabs or tenons on first ends of these bars into holes, channels or mortises at the other ends of matting associated bars. Locking pins are inserted into holes that are aligned in both the mortise portions and the tab portions that mate with one another. Such locking pins also serve for looping of yarn but also prevent loom bars or components from separating after they have been assembled. The remaining pegs or pins may be inserted into the other uniformly spaced holes on each of the loom bars or elements before or after the loom is assembled and ready for use.

BRIEF DESCRIPTION OF THE DRAWINGS

Those skilled in the art will appreciate the improvements and advantages that derive from the present invention upon reading the following detailed description, claims, and drawings, in which:

FIG. 7*a* and FIG. 7*b* are top plan and side elevational views, respectfully, of an L-shaped bar forming part of the kit;

DESCRIPTION OF THE PREFERRED EMBODIMENTS

Figure 1:
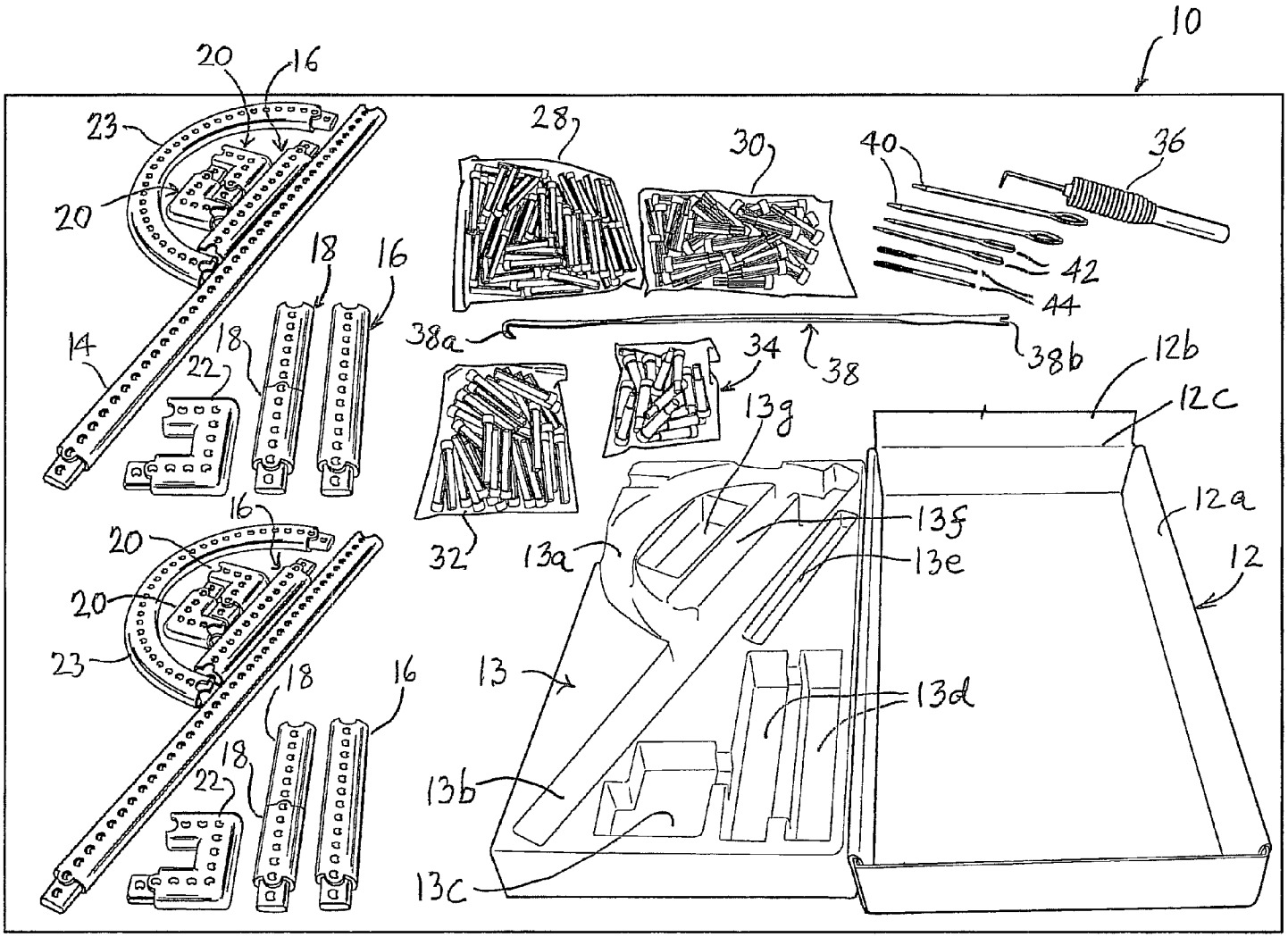
FIG. 1 is an exploded view of a kit of a modular adjustable frame hand loom, showing the various components packaged together in a non-fully assembled form for retail sale to consumers.

Referring now more specifically to the Figures, in which identical or similar parts are designated by the same reference numerals throughout, and first referring to FIG. 1, a kit for a modular adjustable frame hand loom is generally designated by the reference numeral 10.

The kit 10 includes a plurality of components or items that are packaged together for retail sale to consumers in a non-assembled form.

The kit 10 includes a box, carton or container 12 having a generally shallow rectangular receptacle 12*a* and a cover 12*b*, part of which has been removed for illustrative purposes, that is hinged about edge 12*c* for selectively exposing the receptacle 12*a* as shown or for closing the box and securing the components therein.

A tray or insert 13 is molded to generally conform to the interior space or compartment of the receptacle 12*a* so that it can be received therein with little clearance for the lateral movements. The insert or tray 13 includes recesses 13*a*-13*g* accessible from the upper surface of the tray, as shown, to securely receive a plurality of kit components to prevent same from shifting within the box 12.

As will be more fully discussed, the loom kit includes a plurality of elongate sections, including long bars 14, medium bars 16, short bars 18, L-bars 20, U-bars 22 and arcuate or semicircular bars 23. While different numbers of bars may be provided in differently sized kits, the kit illustrated includes two long bars 14, four medium bars 16, four short bars 18, four L-bars 20, two U-bars and two arcuate or semicircular bars 23.

Also included in the kit are four pouches or bags of pegs. A first bag includes 166 small pegs 28, a second bag includes 86 large pegs 30, a further bag includes 41 small pegs and a still further bag includes 20 large pegs. Preferably, the pegs 28, 30, 32, 34 are provided in different colors. In the illustrated kit, the pegs 28 are blue, the pegs 30 are pink, the pegs 32 are orange and the pegs 34 are grey. By providing small and large pegs, to be more fully described, and color coding these pegs, the pegs can be arranged to facilitate the use of the loom and avoid the need to mark certain pegs for certain knitting operations.

A weaving tool 38 is provided in the kit that includes a hook 38*a* at one end and a yarn pusher or manipulator 38*b* at the other end. Different size needles are advantageously provided including two long needles 40, two medium needles 42 and two short needles 44. Also, included in the kit 10 is an L-shaped hook 36 that included a handle 36*a* and an L-shaped or right angle hook 36*b*.

Figure 2:
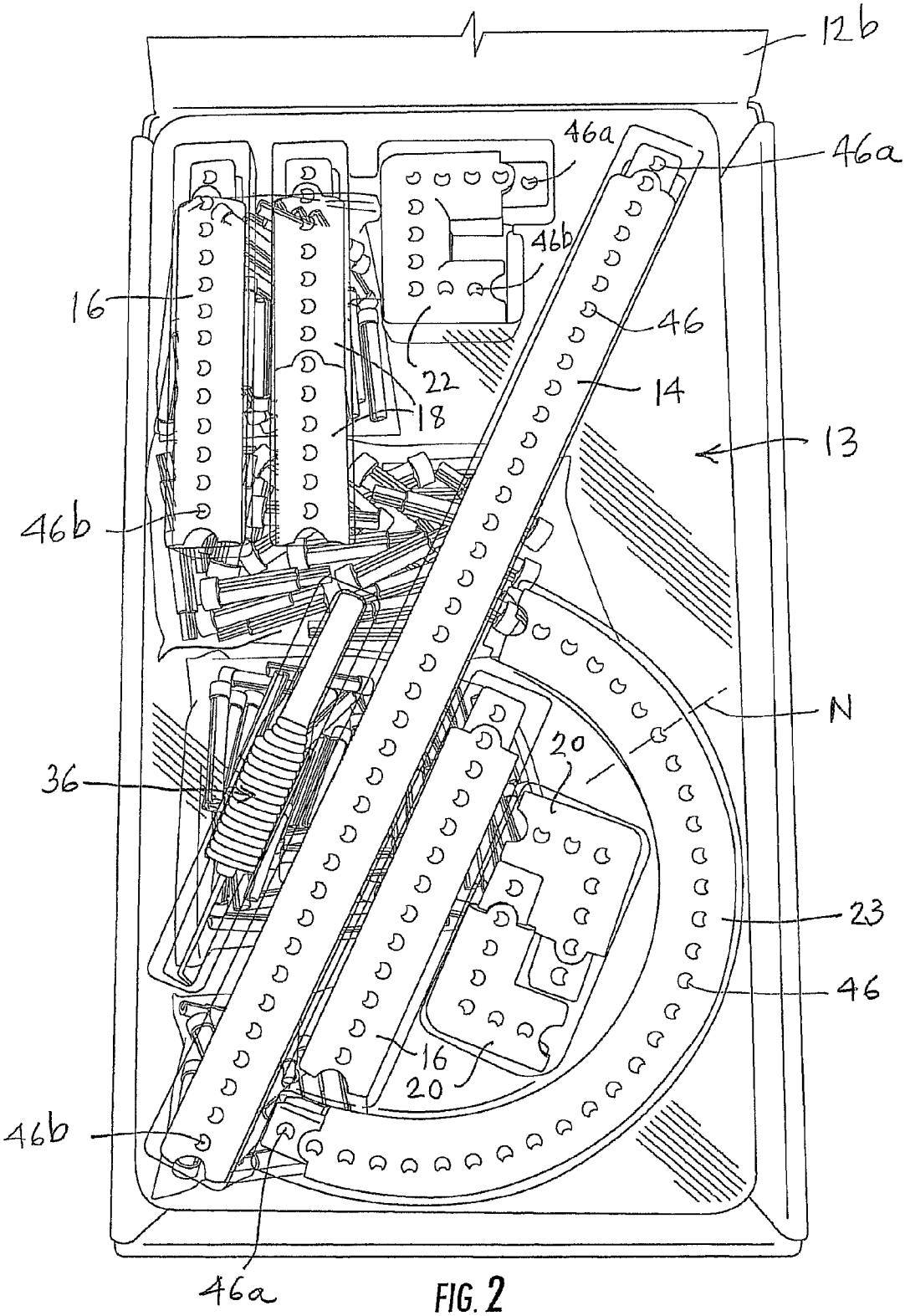
FIG. 2 is a top plan view of the kit shown in FIG. 1, with all of the components received within a molded insert or tray as packaged within a box that is closed when sold at retail.

In FIG. 2, the above described components are illustrated within the box 12 as the kit is configured at the point of purchase, and also as kit components would be arranged when the kit is dissembled and placed back in the box and within the tray 13 for storage. All of the components mentioned are received within mating recesses except for the pegs and the needles which are placed in the box prior to insertion of the tray 13 in the box and, therefore, are situated below the tray. These are partially visible through the transparent tray in FIG. 2.

Referring to FIG. 2, each of the bars 14, 16, 18, 20, 22 and 23 include the plurality of the crescent-shaped holes or apertures 46 that are uniformly spaced from each other along the longitudinal directions of the bars. The specific shapes or cross sectional areas of the holes 46 are not critical as long as these holes are not circular. Any hole configurations may be used as long as it defines unique directions for the pins or pegs when inserted into the holes. Referring to FIG. 2, the arcuate or semi-circular bar 23 is shown to define a normal direction N that is perpendicular to the general longitudinal direction of the bar. The holes 46, as will be clear from the description of FIGS. 3*a*, 3*b*, ensure that the pegs are always arranged with a certain grooved or notched surface of the pegs always facing outwardly in the normal direction N at each hole position on the bars.

Figure 3A:
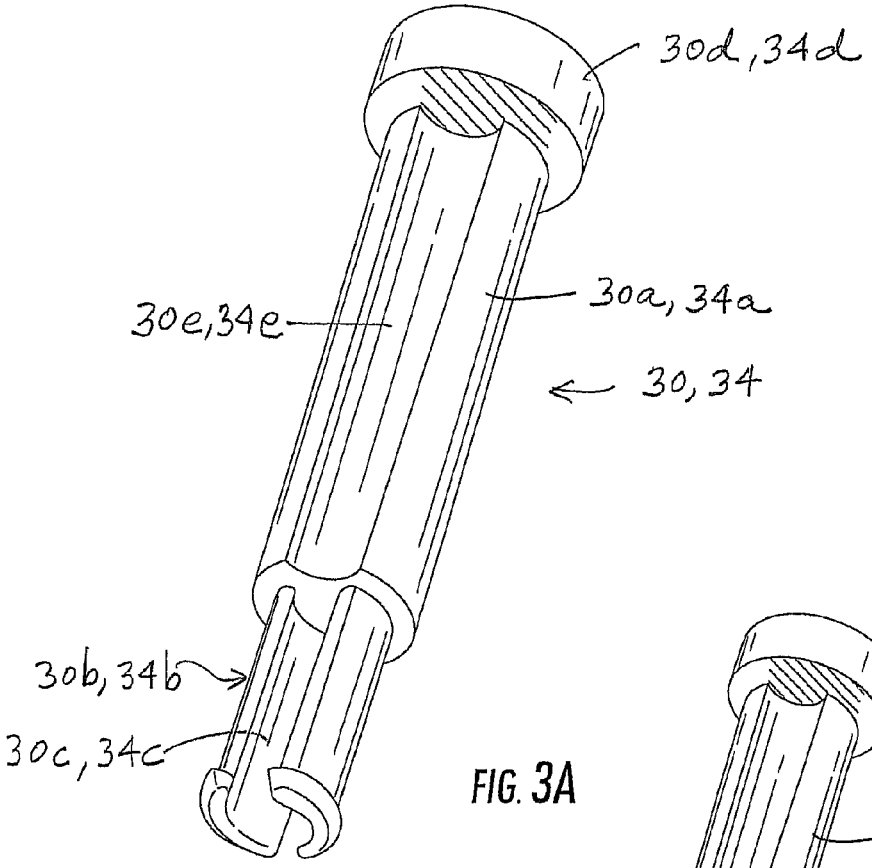
FIG. 3*a* is a perspective view of a larger peg or pin that forms part of the kit and is used in connection with the adjustable hand loom of the present invention.
Figure 3B:
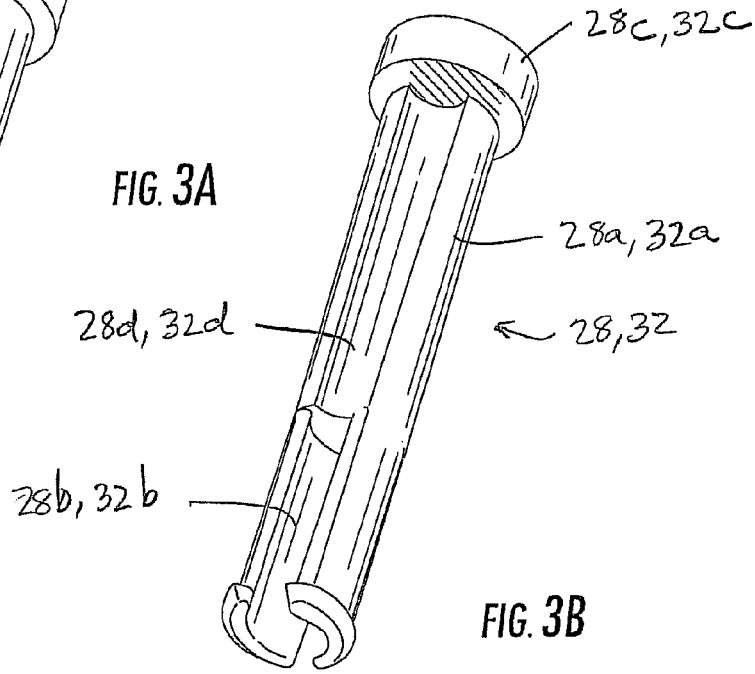
FIG. 3*b* is a perspective view of a smaller peg or pin forming part of the kit and used in connection with the adjustable loom.

Referring to FIG. 3*a*, a perspective view is shown of the large pegs 30, 34. The pegs 30, 34 include a shank 30*a*, 34*a*, a foot 30*b*, 34*b*, at one end of the shank configured to be received and mate with the crescent-shaped holes 46. A head 30*d*, 34*d* is provided at the other end as shown. The foot 30*b*, 34*b* may either be solid and have a cross section corresponding to the cross section of the holes 46 or may, preferably, be split to provide a gap or space 30*c*, 34*c* as shown. The legs 30*b*, 34*b* may be press fit into the holes 36 with or without the split 30*c*, 34*c*. However, when split the legs provide some additional resiliency to facilitate insertion and removal of the pegs from the bars. The legs, in the described embodiment, are 10.8 mm high along the axial or right direction of the pegs, while the entire pegs are 38.5 mm. The height of the peg without the head is 33.5 mm. The diameter of the shank 30*a*, 34*a* is 6.6 mm while the maximum dimension of the foot 30*b*, 34*b* is 4.76 mm. The shanks 30*a*, 34*a* are provided with axial recesses, groves or channels 30*e*, 34*e* on the exterior surface as shown that serve as guides for the points of hooks or needles to facilitate and increase the sped of engaging the looped yarns. Referring to FIG. 3*b*, the smaller pegs 28, 32 have a shank 28*a*, 32*a* that it is of substantially uniform cross section and may or may not be provided at the lower end with a split or gap 28*b*, 32*b* shown. As with the larger pegs, the smaller pegs also have a head 28*c*, 32*c* at the opposite or upper end. The shorter pegs are likewise provided with axial recesses, grooves or channels 28*d*, 32*d* as shown, which can also conform the cross-section of the crescent-shaped holes 46 so that the pegs need not to be stepped. The smaller pegs are somewhat shorter at 36.2 mm, while the height of the shank 28*a*, 32*a* is 31.2 mm. The maximum dimension of the shank 28*a*, 32*a* of the shorter pegs is 4.76 mm—the same as that dimension for the larger pegs since in both cases the lower ends of the pegs must be received within the same crescent shaped holes 46. Therefore, while the shorter pegs have a shank with a cross section that substantially corresponds to the cross sections of the holes 46 only the lower part of the larger pegs 30, 34 have such cross section and the peg is stepped to a large diameter, as shown, above the insertion portion up to the head 30*d*, 34*d*. The two different size pegs are used to provide added versatility or flexibility to people who use the loom for knitting or weaving. While the person using the loom generally decides what pegs to use, and the spacing of the pegs, for any given application, it is typical that the smaller sized pegs 28, 32 would generally be used for lighter weight yams, while the larger pegs are more appropriate for heavier weight yarns. Thus, for example, the smaller pegs may be used with the following yarn categories: lace, superfine, fine and light, while the larger pegs can be used with yarn categories: medium, bulky and super bulky. This generally follows the recommended U.S. needle size ranges 000-7, and 7 to −11 larger needles, respectively.

Figure 4:
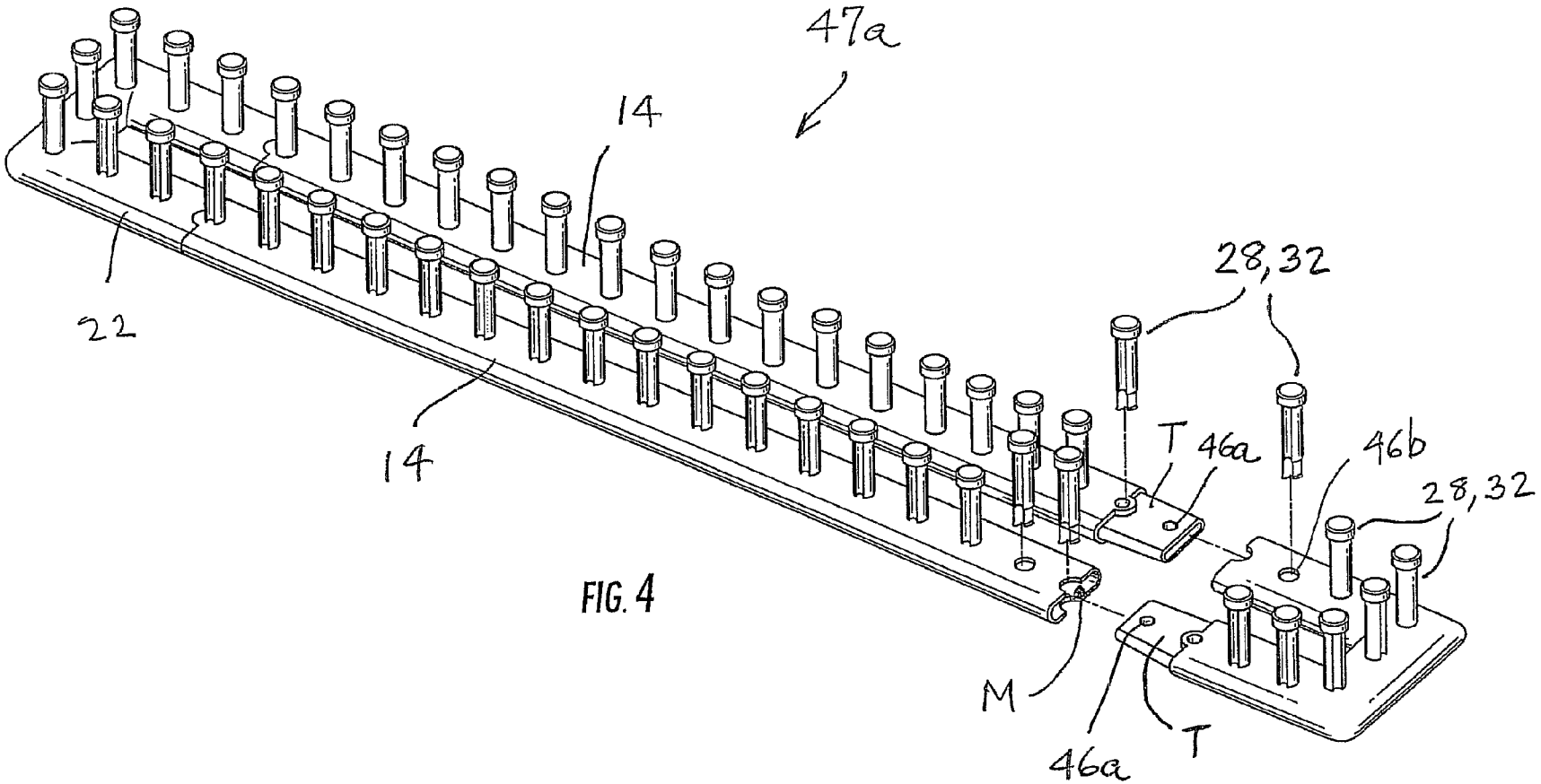
FIG. 4 is a perspective view of a loom using the components of the kit shown in FIGS. 1 and 2 to create an elongated loom frame, shown in partially disassembled form with one component or element of the kit in a position for completing or closing the frame.

Numerous fixed loom configurations can be formed with the elements or components making up the kit and some of these will now be described. Referring to FIG. 4 a generally elongate frame loom is shown in a condition of near full assembly. Loom 47*a* is formed of two long bars 14, joined or secured to each other at their ends by means of two U-shaped bars 22. In FIG. 4 one of the U-shaped bars is shown connected to the long bars 14 while the other U-shaped bar 22 is shown positioned just prior to full assembly of the loom or just after disassembly of the first part of the loom for storage.

In FIG. 4, all of the bars, irrespective of their shape or configuration are provided with two free ends one of which is provided with an axial tab or tenon T, while the opposing end is provided with a channel or mortise M dimensioned and configured to slidably receive the tabs T. In assembling a loom the tabs at one end of a bar is mated with a channel M of an associated bar. An important feature of the invention is the provision of holes 46*a* on the tabs or tenons T that are equally spaced from the next hole as are all of the uniformly spaced holes from each other and holes 46*b* are likewise provided at the channel or mortise ends M that are aligned with the holes 46*a* when the tabs T are fully inserted into the channels M. In this way, a pin or peg that passes through the aligned holes 46*a*, 46*b* has a dual function, namely serving as a peg or pin for looping yarn but also as a locking peg to prevent inadvertent separation of two bars from each other by inadvertent separation of a tab T from an associated channel M.

Figure 5:
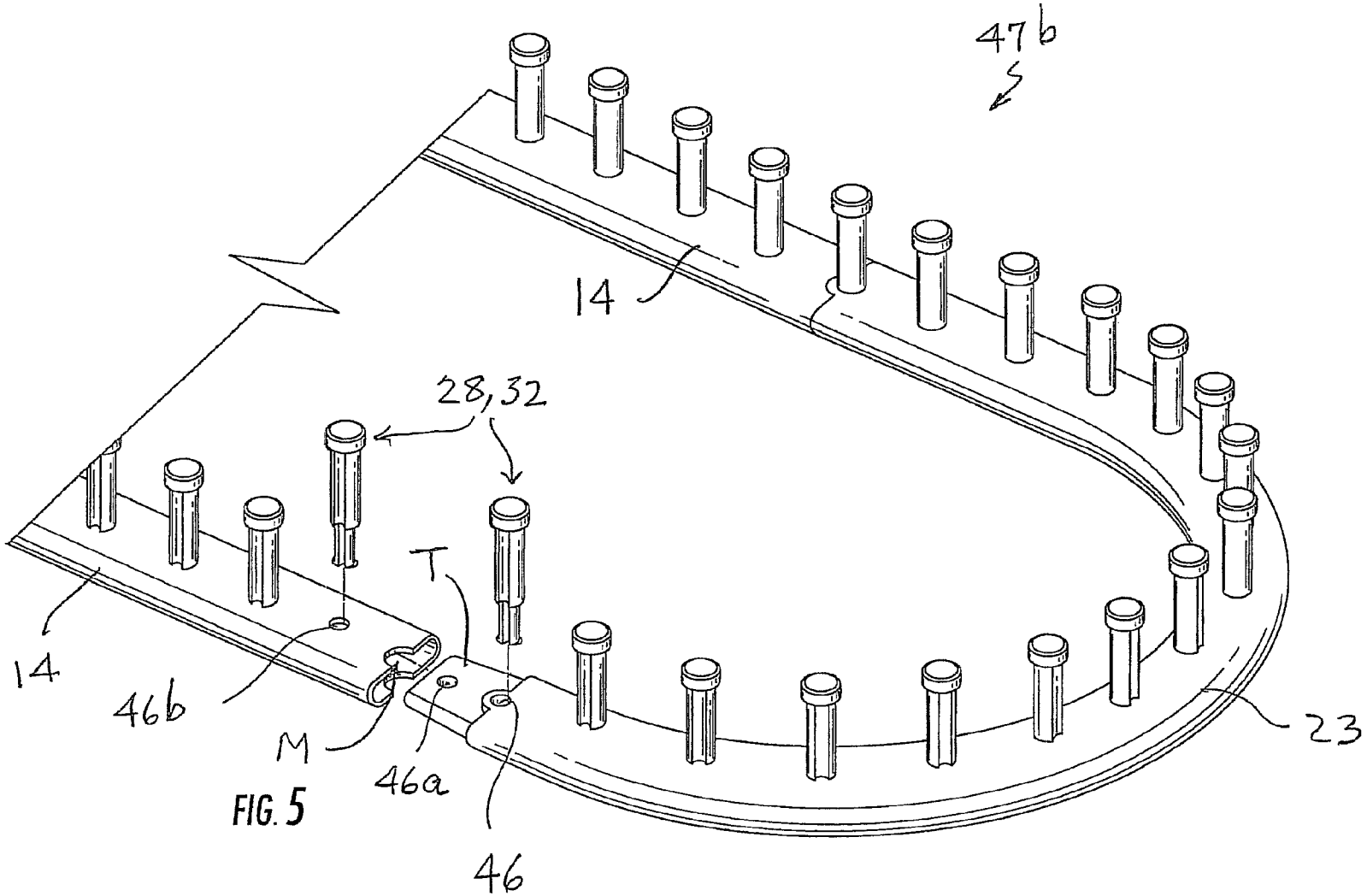
FIG. 5 is a fragmented perspective view similar to FIG. 4 but illustrating a generally oval frame construction obtainable with the components of the kit, showing two butting or associated components or bars aligned in a position for final assembly.
Figure 6:
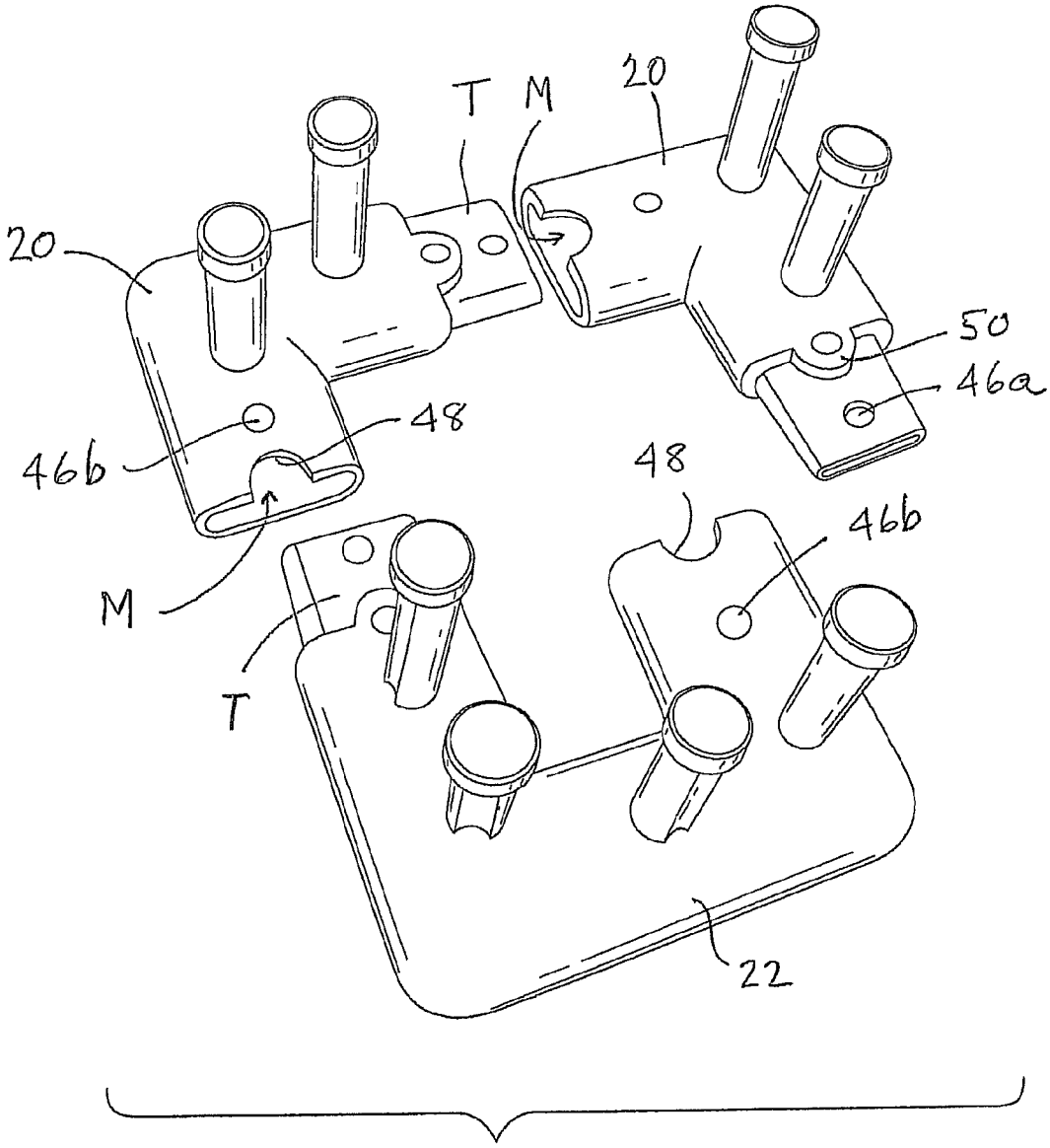
FIG. 6 is an exploded perspective view similar to FIGS. 4 and 5 but using components of the kit to form a generally rectangular handloom frame.
Figures 8A, 8B, 8C, 8D, 8E, 8F, 8G:
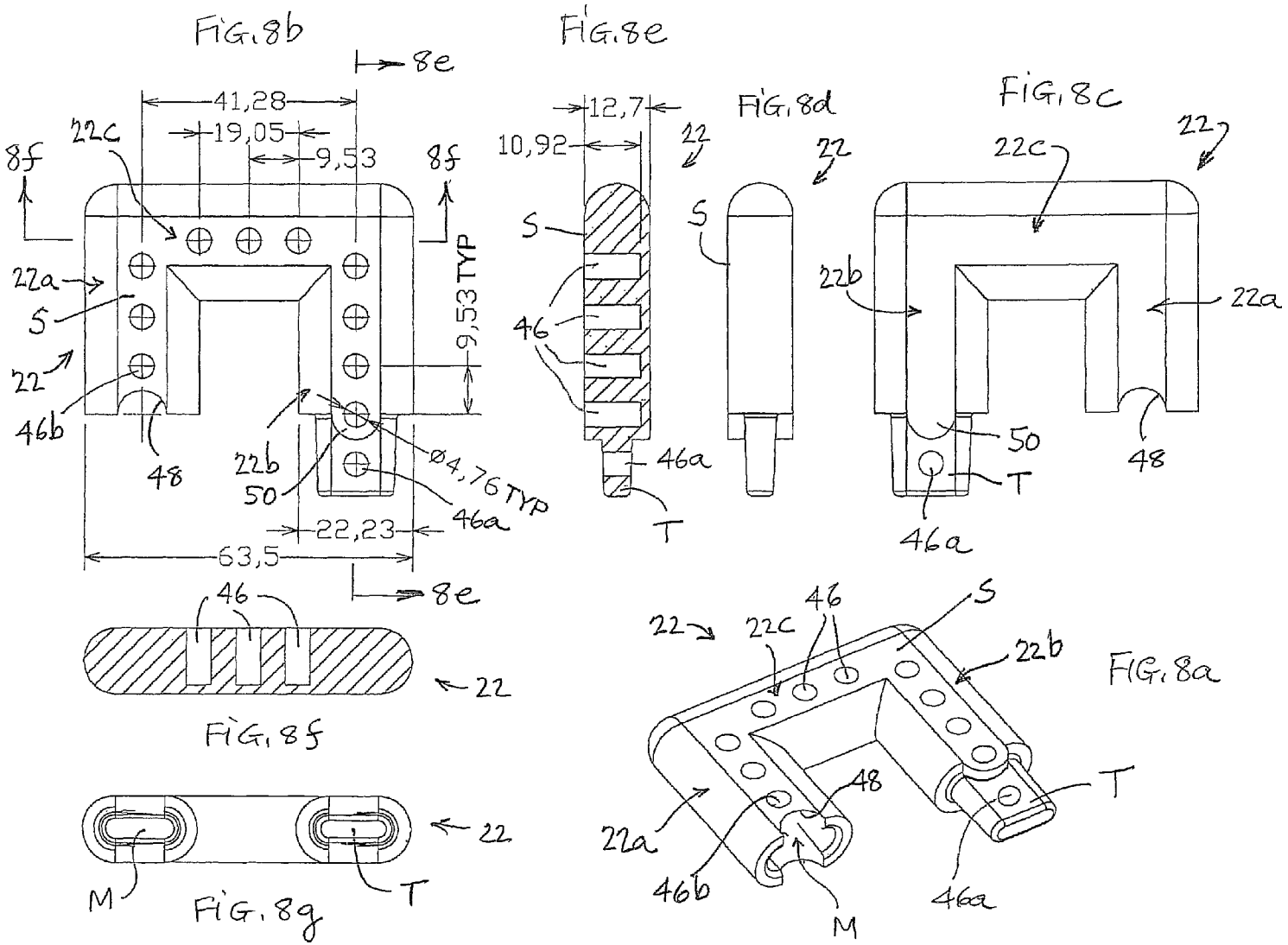
FIGS. 8*a*-8*g* are perspective, elevational, plan and cross-sectional views of a U-shaped bar forming part of the kit.

Referring to FIG. 5, another possible configuration for a loom is shown and designated by the reference numeral 47*b*. In FIG. 5, a generally oval shaped loom is shown in which only a portion of the loom is illustrated and the rest is broken away. As with the loom 47*a*, loom 47*b* may be formed by using two long bars 14. However, instead of utilizing a U-shaped bar 22 arcuate or semi circular bars 23 are used. This provides rounded ends but also increases the space separation between the long bars. As evident from the pins 30, 34, in particular the pin that is aligned to be inserted but not yet inserted into the bars the shanks are stepped to provide a smaller diameter and that is receivable within the aligned holes 46*a*, 46*b*, while the upper portions of the shank are of larger diameter. Other configurations can be created as suggested in FIG. 6 in which one U-shaped bar 22 is shown in the process of being assembled with two L-shaped bars 20. As will be more evident in connection with FIGS. 7*a*, 7*b* the tabs or tenons T are preferably tapered as shown and the channels or mortises M are similarly tapered to facilitate insertion and assembly of the looms. Locking pegs are inserted into the aligned holes 46*a*, 46*b* after the bars have been mated and fully inserted into abutting relationship against each other. The remaining non-locking pegs or pins can be inserted either prior or subsequent to assembly of the frame into the desired geometrical configuration.

Some additional details of the described bars will now be discussed in relation to FIGS. 7*a*-12*f*. In FIGS. 7*a*, 7*b* the L-shaped bar 20 is shown to have two legs 20*a*, 20*b* normal to each other, and a top surface S. The leg 20*a* has an end surface 20*f* while the leg 20*b* has an end surface 20*g*. The tab T projects beyond the end surface 20*f*. An optional cutout 48, as shown, extends into the leg 20*b*, while a protuberance or projection 50 projects beyond the end surface 20*f*. The protuberance or projection 50 corresponds to the shape of the cutout 48 so that a protuberance or projection 50 can be received within a cutout 48 of a cooperating bar. As will be evident, the end most holes 46*a* on the tabs T and the holes 46*b* over the mortises M are spaced to correspond to the spacing of the other holes to each other, being 9.52 mm from the respective ends or butting surfaces 20*f*, 20*g*. This way, once two adjacent bars are mated and locked to each other by means of locking pegs or pins, the holes 46*a*, 46*b* and the locking pegs mounted therein merely form part of a continuum of uniformly spaced pegs along the assembled loom.

The remaining details of the other shaped bars should be evident from the description of the L-shaped bar shown in FIGS. 7*a*, 7*b*, as all of these bars share basic common features, namely overall cross-sectional configurations, the spacing of the holes 46 for the pegs, the cutouts 48 and the projections 50. Thus, in FIGS. 8*a*-8*g* details of the U-shaped bars 22 are shown, each consisting of legs 22*a*, 22*b* and 22*c*. As with the L-shaped bar tabs T and channels M are provided at the free ends 20*g*, 20*f*, the spacing between the holes 46 on the legs 22*a*, 22*b* being 41.28 mm to form a loom, when connected with straight bars, having a maximum thickness dimension of 63.5 mm.

Figures 9A, 9B, 9C, 9D, 9E, 9F, 9G:
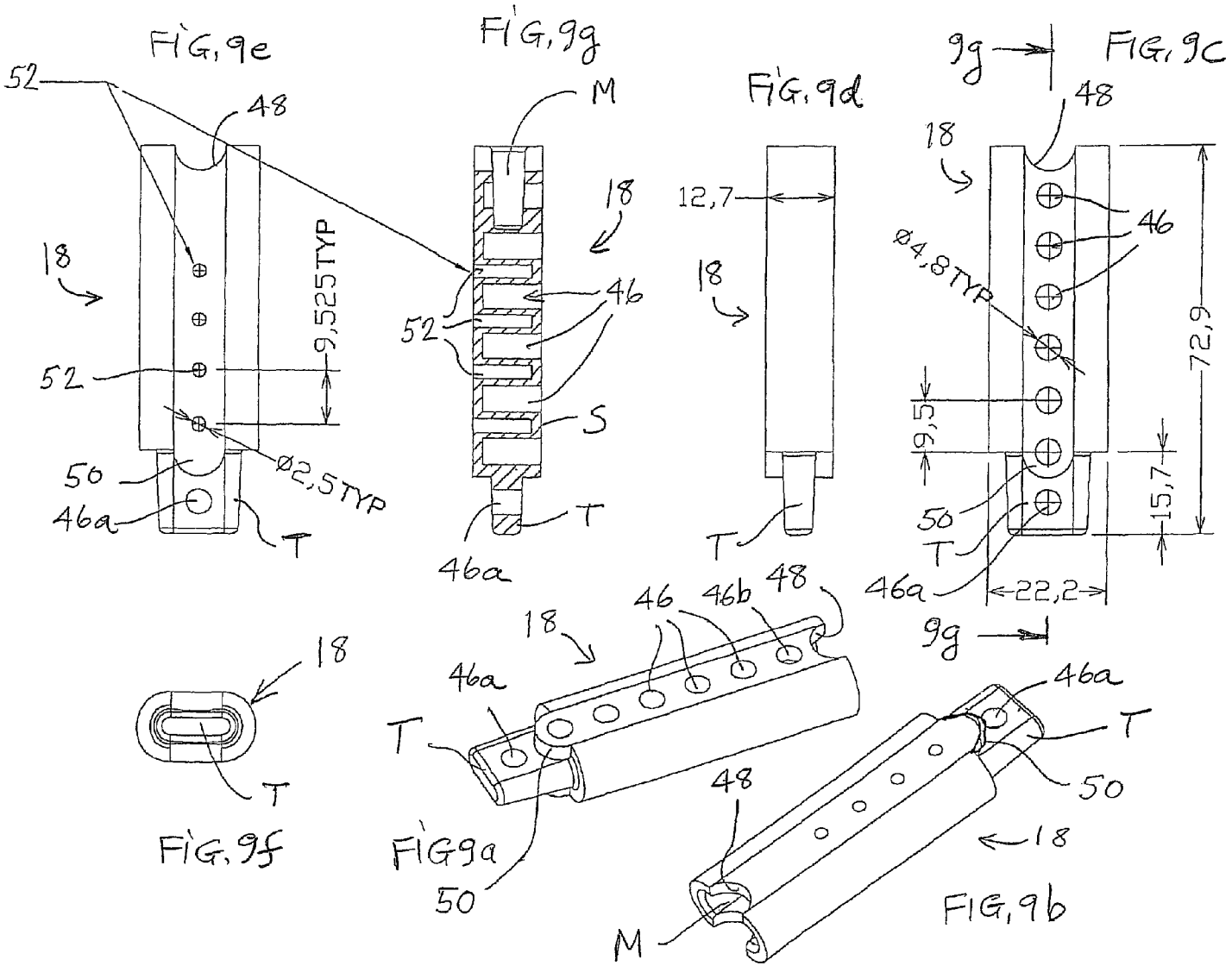
FIGS. 9*a*-9*g* are perspective, elevational, plan and cross-sectional views of a short bar forming part of the kit.
Figures 10A, 10B, 10C, 10D, 10E, 10F:
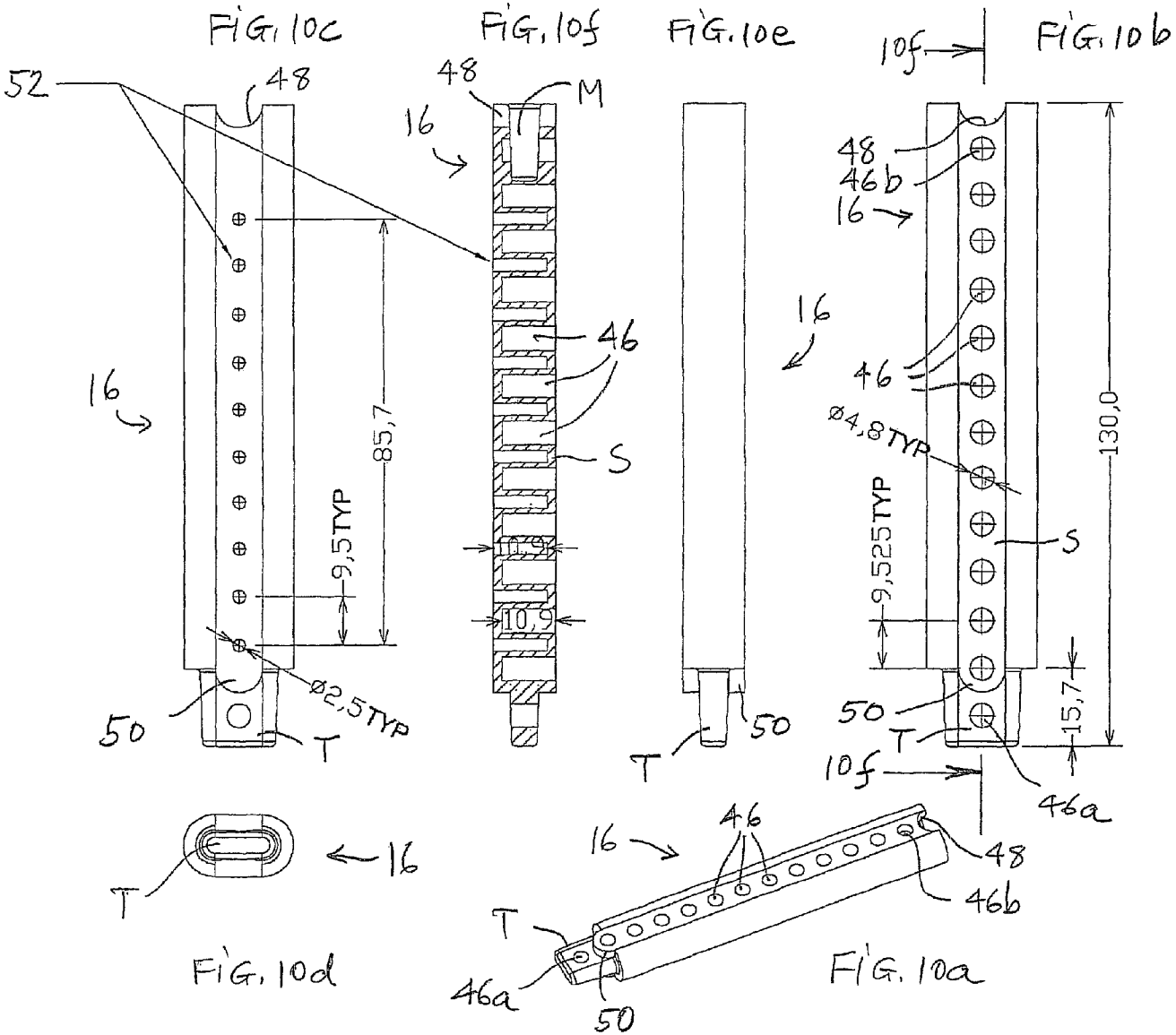
FIGS. 10*a*-10*f* are similar to FIGS. 9*a*-9*g* but showing details of a medium-sized bar forming part of the kit.
Figures 11A, 11B, 11C, 11D, 11E:
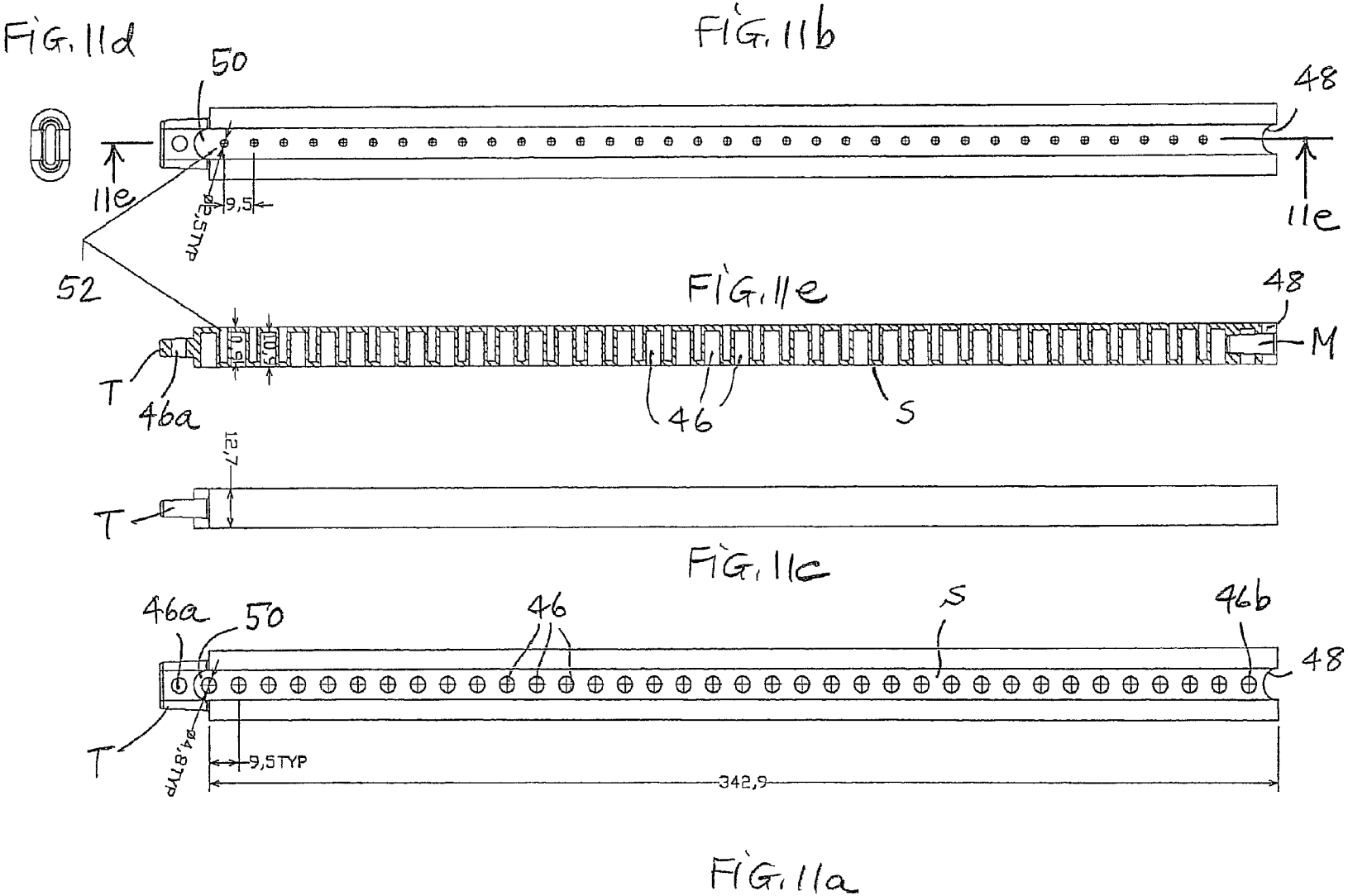
FIGS. 11*a*-11*e* are similar to FIGS. 10*a*-10*f* but showing details of a long bar forming part of the kit.
Figures 12A, 12B, 12C, 12D, 12E, 12F:
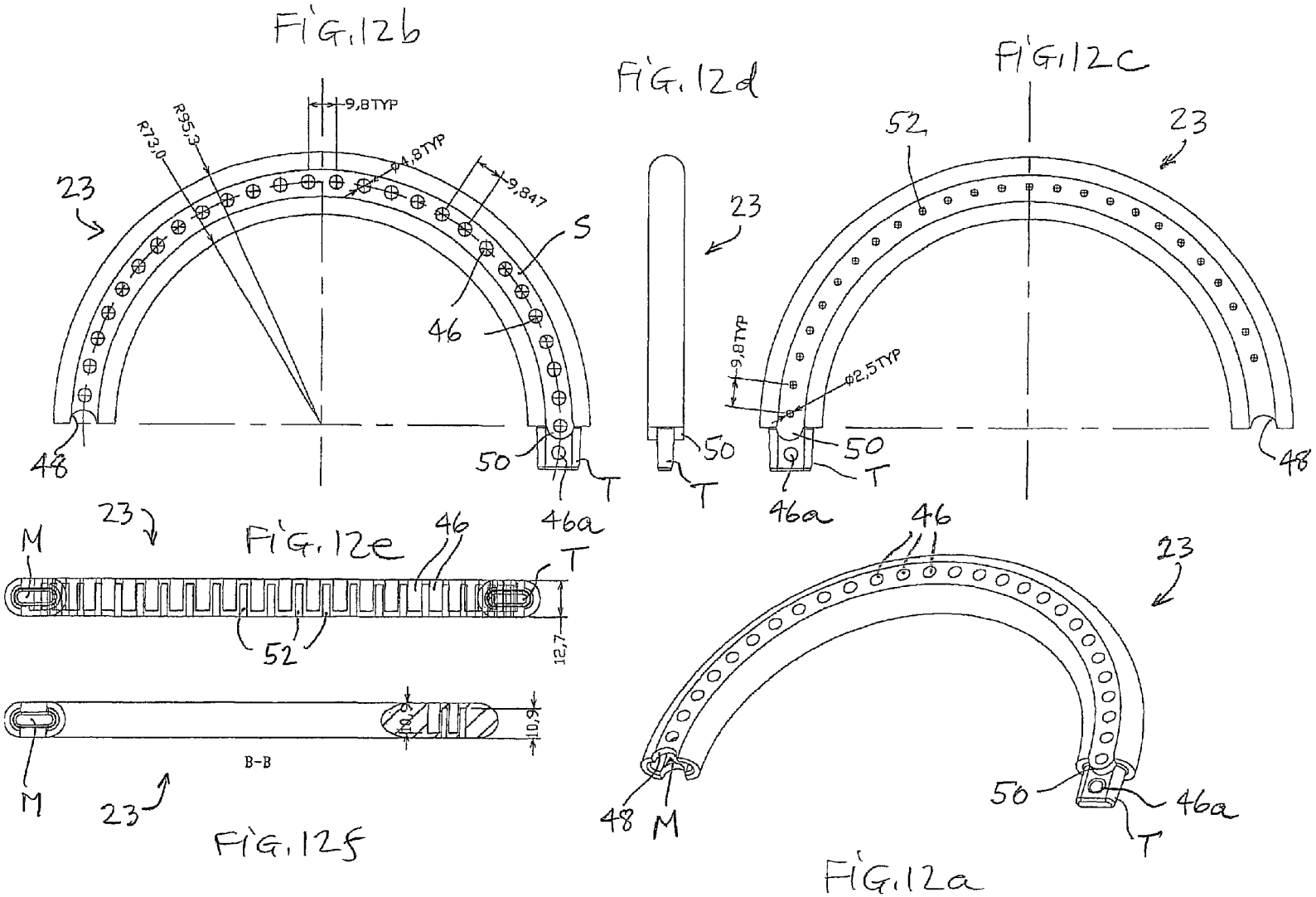
FIGS. 12*a*-12*f* are perspective, plan, elevational and cross-sectional views of an arcuate bar forming part of the kit.

FIGS. 9*a*-9*g* are generally similar to FIGS. 8*a*-8*g* but illustrate the details of the short bars 18. While the U-shaped bars in FIGS. 8*a*-8*g* are only provided with holes 46 on the top surface S, shown in FIGS. 8*b*, 8*e* and 8*f*, the straight bars illustrate another optional feature, namely the removal of molding material between the holes 46. Thus, optional holes 52 are illustrated in FIGS. 9*b*, 9*e* and 9*g* that open on the opposing or bottom surface B from the top surface S. Provision of the optional holes 52 eliminates material and therefore renders the bars less costly to manufacture and also results in lighter bars, and an assembled loom that weights less. It will be noted that the shorter bars typical have an overall length of 72.9 mm while the other dimensions generally correspond to those of the U-shaped bars 22.

FIGS. 10*a*-10*f* are generally similar to FIGS. 9*a*-9*f* for the medium bars 16. These bars are also shown to be provided with the optional holes 52, although the overall length of these bars is 130 mm. Similarly, FIGS. 11*a*-11*e* are generally similar to the Figures shown for the short and medium bars but indicate that the long bars 14 are 342.9 mm long between the end surfaces 20*f*, 20*g*.

FIGS. 12*a*-12*f* are generally similar to the Figures illustrating the straight bars 14, 16, 18 although the bars 23 are arcuate and have a semi-circular shape. The inner and the outer diameters are 73 and 95.3 mm, respectively. Otherwise, the bars are provided with the optional holes 52, which holes are generally provided in the longer kit members result in elimination of material and weight reduction. Smaller components, such as the L-shaped and U-shaped bars 20, 22 need not generally be provided with the optional holes 52 as these components are generally small and light weight.

It will be evident that the kit 10 in accordance with the present invention makes it possible to easily assemble and disassemble selected components to provide a fixed frame hand loom that conforms to the size and shape desired for a given operation and size of resulting product. Thus, the sections or bars 14, 16, 18, 20, 22 and 23 can be assembled to form, for example, a round loom, weaving loom, rake loom, and floret loom. The pegs or pins are not integrally formed with the bars. This allows the pins to serve multiple functions as indicated, to lock and secure the bars to each other in an assembled loom. However, this also allows the appropriate pegs to be used for different applications. Smaller or larger pegs may be used to match the weights of the yarns and the pegs can also be color coded to facilitate in the knitting or weaving operations. Also, by having pegs that can be easily inserted or removed from the bars, the looms have added flexibility or versatility since certain of the pegs may be removed so that pegs are only inserted into every other hole 46, for example. This may be advantageous in certain operations.

When the user has completed a project, all the pegs, including the locking pegs may be removed and the bars may be easily and conveniently separated and replaced into the appropriate recesses of the insert or tray 13 within the box 12 so that all of the component parts remain organized and may be readily reused at a future date.

The looms in accordance with the invention can be used, once assembled, in the same ways as knitting and weaving has been done on prior art frame looms. Examples of how such looms are used are described in U.S. Pat. Nos. 2,072,668; 3,967,467; 4,158,296 and 4,248,063.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What claimed is:

1. An adjustable knitting and weaving hand loom comprising a plurality of generally elongate sections each of which defines an upper surface and opposing first and second ends;

connecting means on said sections for connecting said plurality of sections to form a closed frame by connecting each section with two other adjoining sections in end-to-end abutment by joining a first end of one section with a second end of another adjoining section, said connecting means comprising an axial tab at each first end and a mating axial channel at each second end to provide a sliding joint between each two adjoining sections by inserting an axial tab of one section into an axial channel of an adjoining section to provide a stable joint to substantially prevent relative movements between each two adjoining sections except along the direction of insertion of said axial tab into said axial channel, each of said sections being provided on said upper surface and on said axial tab with a series of substantially uniformly intermediate spaced holes or bores each having axes substantially normal to said upper surface, said holes or bores being arranged to align endmost holes or bores at said second ends with said end-most holes or bores in said axial tabs at said first ends when said axial tabs are fully slidably inserted and mated within associated axial channels to form slip joints; and a plurality of pegs or pins each having at least one end portion dimensioned to be securely received within intermediate holes or bores of said sections and within aligned end-most holes or bores within said axial channels at said second ends and within said tabs at said first ends at each slip joint, whereby said pegs or pins inserted into said end-most bores or holes at said second ends and into said end-most bores or holes in said tabs function both to loop yarn during knitting and to lock said axial tabs from inadvertently separating from mating axial channels by movements along said direction of insertion.

2. A hand loom as defined in claim 1, wherein said tabs and channels are tapered to facilitate insertion and assembly of the loom.

3. A hand loom as defined in claim 1, wherein each peg end portion is resilient and dimensioned to provide a press fit into said holes.

4. A hand loom as defined in claim 1, wherein said holes have non-circular cross-sectional shapes and said pins or pegs are each provided with a longitudinal groove beyond said end portions, said end portions of said pins or grooves having configurations and dimensions corresponding to said non-circular shapes to be received within said non-circular holes with an angular orientation to position said longitudinal grooves facing in a direction substantially normal to a length direction of an associated elongate section.

5. An adjustable knitting and weaving hand loom kit including an assembly of components packaged together for retail sale to consumers in a non-fully assembled form and comprising a plurality of generally elongate sections each of which defines an upper surface and opposing first and second ends;

connecting means on said sections for connecting said plurality of sections to form a closed frame by connecting each section with two other adjoining sections in end-to-end abutment by joining a first end of one section with a second end of another adjoining section, said connecting means comprising an axial tab at each first end and a mating axial channel at each second end to provide a sliding joint between each two adjoining sections by inserting an axial tab of one section into an axial channel of an adjoining section to provide a stable joint to substantially prevent relative movements between each two adjoining sections except along the direction of insertion of said axial tab into said axial channel, each of said sections being provided on said upper surface and on said axial tab with a series of substantially uniformly spaced intermediate holes or bores each having axes substantially normal to said upper surface, said holes or bores being arranged to align end-most holes or bores at said second ends with said end-most holes or bores in said axial tabs at said first ends when said axial tabs are fully slidably inserted and mated within associated axial channels to form slip joints; and a plurality of pegs or pins each dimensioned to be securely received within intermediate holes or bores of said sections and within aligned end-most holes or bores within said axial channels at said second ends and within said tabs at said first ends at each slip joint, whereby said pegs or pins inserted into said end-most bores or holes at said second ends and into said end-most bores or holes in said tabs function both to looping yarn during knitting and to lock said axial tabs from inadvertently separating from mating axial channels by movements along said direction of insertion.

6. A kit as defined in claim 5, wherein said tabs and channels are tapered to facilitate insertion and assembly of the loom.

7. A kit as defined in claim 5, wherein each peg end portion is resilient and dimensioned to provide a press fit into said holes.

8. A kit as defined in claim 5, wherein said holes have non-circular cross-sectional shapes and said pins or pegs are each provided with a longitudinal groove beyond said end portions, said end portions of said pins or grooves having configurations and dimensions corresponding to said non-circular shapes to be received within said non-circular holes with an angular orientation to position said longitudinal grooves facing in a direction substantially normal to a length direction of an associated elongate section.

9. A kit as defined in claim 5, wherein said plurality of sections comprise differently shaped elongate sections.

10. A kit as defined in claim 9, wherein said elongate shaped sections include straight and curved sections.

11. A kit as defined in claim 9, wherein said elongate sections include U-shaped sections.

12. A kit as defined in claim 9, wherein said elongate sections include semi-circular sections.

13. A kit as defined in claim 5, wherein said kit includes straight, semi-circular and U-shaped sections.

14. A kit as defined in claim 5, wherein said kit includes at least one of an L-shaped hook and a weaving tool.

15. A kit as defined in claim 5, further comprising a container provided with recesses substantially corresponding to the shapes and dimensions of said elongate sections for receiving and storing said plurality of elongate sections when not in use.

16. A kit as defined in claim 5, wherein said elongate sections include at least two different length sections.

17. A kit as defined in claim 5, wherein said plurality of pegs or pins include at least two differently sized pegs or pins.

18. A kit as defined in claim 5, further comprising at least one needle.

19. A method of assembling an adjustable knitting and weaving hand loom comprising providing a plurality of generally elongate sections each of which defines an upper surface and opposing first and second ends;

connecting each section with two other adjoining sections in end-to-end abutment by joining a first end of one section with a second end of another adjoining section, said connecting means comprising an axial tab at each first end and a mating axial channel at each second end to provide a sliding joint between each two adjoining sections by inserting an axial tab of one section into an axial channel of an adjoining section to provide a stable joint to substantially prevent relative movements between each two adjoining sections except along the direction of insertion of said axial tab into said axial channel, each of said sections being provided on said upper surface and on said axial tab with a series of substantially uniformly spaced intermediate holes or bores each having axes substantially normal to said upper surface, said holes or bores being arranged to align end-most holes or bores at said second ends with said end-most holes or bores in said axial tabs at said first ends when said axial tabs are fully slidably inserted and mated within associated axial channels to form slip joints; and inserting a plurality of pegs or pins into said holes or bores, each peg or pin being dimensioned to be securely received within intermediate holes or bores of said sections and within said end-most aligned holes or bores within said axial channels at said second ends and within said tabs at said first ends at each slip joint, whereby said pegs or pins inserted into said end-most bores or holes at said second ends and into said end-most bores or holes in said tabs function both to looping yarn during knitting and to lock said axial tabs from inadvertently separating from mating axial channels by movements along said direction of insertion.

20. A component part of a multi-component kit for use with an adjustable knitting and weaving hand loom for weaving yarn comprising an elongate section that defines an upper surface and a first end configured as an axial and a mating axial channel at an opposing second end, an axial tab at said first end, said axial tab having an external configuration and dimensions corresponding to the internal configuration and dimensions of said channel, a plurality of substantially uniformly spaced intermediate holes or bores each having axes substantially normal to said upper surface and including two end most holes or bores one extending through said axial tab and one extending through said channel, respectively, whereby a peg inserted into aligned end most holes in a tab and a channel of two associated component parts that are mated with each other can be used both for looping yarn and for locking the two associated parts against inadvertent separation.

* * * * *